US009328541B2

(12) United States Patent
Langh

(10) Patent No.: US 9,328,541 B2
(45) Date of Patent: May 3, 2016

(54) LOCKING ARRANGEMENT

(75) Inventor: Hans Langh, Piikkio (FI)

(73) Assignee: LANGH GROUP OY AB, Piikkio (FI)

( * ) Notice: Subject to any disclaimer, the term of this patent is extended or adjusted under 35 U.S.C. 154(b) by 686 days.

(21) Appl. No.: 13/377,609

(22) PCT Filed: Jun. 10, 2010

(86) PCT No.: PCT/FI2010/050480

§ 371 (c)(1),
(2), (4) Date: Dec. 12, 2011

(87) PCT Pub. No.: WO2010/142855

PCT Pub. Date: Dec. 16, 2010

(65) Prior Publication Data

US 2012/0087717 A1 Apr. 12, 2012

(30) Foreign Application Priority Data

Jun. 12, 2009 (FI) ..... 20095671

(51) Int. Cl.
*E05B 83/02* (2014.01)
*B65D 88/12* (2006.01)

(52) U.S. Cl.
CPC ..... *E05B 83/02* (2013.01); *B65D 88/126* (2013.01); *Y10T 403/32262* (2015.01)

(58) Field of Classification Search
CPC ..... E05C 19/14; E05C 19/145; B65D 88/126
USPC ..... 292/66, 113, 200, 210, 247, 256.69, 292/DIG. 31, DIG. 49, 116, 118, 120, 100, 292/101, 108, 213, 217, 218, 202; 403/33, 403/43–46, 48, 49, 84, 110
See application file for complete search history.

(56) References Cited

U.S. PATENT DOCUMENTS

| | | | | |
|---|---|---|---|---|
| 1,538,124 | A * | 5/1925 | Larson | 217/56 |
| 2,732,238 | A * | 1/1956 | Dornberg | 292/113 |
| 3,661,412 | A * | 5/1972 | Morris | 292/218 |
| 3,709,538 | A * | 1/1973 | Seitz et al. | 292/128 |
| 3,830,705 | A * | 8/1974 | Dewegeli | 202/189 |
| 4,076,290 | A | 2/1978 | Sweger | |

(Continued)

FOREIGN PATENT DOCUMENTS

| | | |
|---|---|---|
| CN | 201224581 | 4/2009 |
| DE | 19643541 A1 | 4/1997 |

(Continued)

OTHER PUBLICATIONS

International Search Report dated Oct. 1, 2010, corresponding to PCT/F12010/050480.

*Primary Examiner* — Gregory Binda
*Assistant Examiner* — Jonathan Masinick
(74) *Attorney, Agent, or Firm* — Young & Thompson

(57) ABSTRACT

A locking arrangement is arranged to lock together a first side and a second side that are at an angle to each other. On the first side, there is a locking member with a bar (6) and a transverse part. On the second side, there is at least one lug (5) and the transverse part (4) is settable to a locked position on the lug (5) on the second side and releasable from the locked position on the lug (5). The lug (5) on the second side is turnable away from beneath the transverse part (4) in the locked position and lockable to remain under the transverse part in the locked position.

18 Claims, 4 Drawing Sheets

(56) References Cited

U.S. PATENT DOCUMENTS

| | | | | |
|---|---|---|---|---|
| 4,391,462 | A * | 7/1983 | Loreal | 292/207 |
| 4,583,442 | A * | 4/1986 | Minor | 84/413 |
| 4,915,913 | A * | 4/1990 | Williams et al. | 422/119 |
| 5,127,684 | A * | 7/1992 | Klotz et al. | 292/113 |
| 5,135,129 | A | 8/1992 | Joly | |
| 6,168,214 | B1 * | 1/2001 | Lambert | 292/200 |
| 6,203,075 | B1 * | 3/2001 | Wells et al. | 292/113 |
| 6,227,581 | B1 * | 5/2001 | Lambert | 292/200 |
| 7,017,955 | B1 * | 3/2006 | Chiang | 292/113 |
| 7,210,712 | B2 * | 5/2007 | Artsiely | 292/97 |
| 8,210,579 | B2 * | 7/2012 | Vilkomirski | 292/100 |
| 2003/0168865 | A1 * | 9/2003 | Tokach et al. | 292/56 |

FOREIGN PATENT DOCUMENTS

| | | |
|---|---|---|
| EP | 0030605 | 6/1981 |
| FI | 20075146 | 8/2008 |
| FR | 2730710 | 8/1996 |
| GB | 1299090 | 12/1972 |
| GB | 1363944 | 8/1974 |
| WO | 2006021734 | 3/2006 |

* cited by examiner

LOCKING ARRANGEMENT

BACKGROUND OF THE INVENTION

The invention relates to a locking arrangement that is arranged to lock together a first side and a second side positioned at an angle, the first side having a locking member with a rod and a transverse part and the second part having at least one lug, and the transverse part being settable in a locked position on the lug on the second side and releasable from the locked position on the lug.

For instance goods transport containers may be equipped with an openable roof to enable loading and unloading of goods being transported from the top by means of a crane. The roof of the container may be locked in place for instance by means of latches or clasps arranged on the top edge of the container. One such solution is shown in publication FR 2730710.

Publication WO 2006021734 presents fastening members for fastening the roof of a container. The fastening members consist of a container-high bar with a handle fastened to the bottom part thereof for turning the bar and of a horizontal part which, when the handle is turned, turns on top of a bottom flange of an I beam in the roof module, thus, locking the roof module in place.

Publication FI 20075146 presents a container roof locking arrangement with a horizontal part preventing the rising up of the container roof and a bar arranged to extend from the horizontal part toward the bottom. At the bottom end of the vertical bar, a handle is arranged for operating the locking arrangement. At one end, the handle is fastened to the wall of the container in such a manner that the handle is turnable relative to its fastening point and movable in the vertical direction. At its bottom end, the vertical bar is fastened to the handle in such a manner that the fastening point of the bar is at a distance from the wall mounting shaft of the handle, whereby pressing the handle downward pulls the bar downward. The fastening point of the vertical bar is located on a different vertical axis and lower than the fastening point of the handle as seen in the locking position.

BRIEF DESCRIPTION OF THE INVENTION

It is an object of the present invention to provide a new type of locking arrangement.

The locking arrangement of the invention is characterised in that a lug is turnable away from beneath the transverse part in a locked position and lockable to remain under the transverse part in the locked position.

The idea of the invention is that the locking arrangement is arranged to lock together a first side and a second side positioned at an angle in such a manner that the first side has a locking member with a rod and a transverse part. The transverse part is settable to a locked position on a lug on the second side and releasable from the locked position on the lug. The lug on the second side is, in turn, arrangeable to turn away from beneath the transverse part in the locked position and lockable to remain under the transverse part in the locked position. Thus, the locking may be opened and closed by using the locking member of the first side and also by turning the lug on the second side. The locking member of the first side can be used from the first side and the lug on the second side may, in turn, be turned from the second side. The locking arrangement may be arranged to the roof of a transport container, for instance, whereby the wall of the transport container forms said first side and the roof of the transport container said second side. The locking of the container roof can then be opened from the side of the container or, if necessary, from the top of the roof. This way, the roof of the container can also be easily detached in a situation where transport containers are loaded side by side into a ship, for instance, so that opening the locking member from the side of the container wall is very difficult. On the other hand, the locking of the roof can also be opened from the side of the container, that is, when there is room enough beside the container, it is not necessary to climb onto the roof to open the locking, which means that work safety is not at risk. Further, the first and second sides may also both be vertical, that is, the corner between them is vertical. In such a case, the presented solution may be utilised by opening the locking from the side that remains stationary after locking. The side being opened then cannot push toward the person opening the locking, that is, it is safe to open the locking.

BRIEF DESCRIPTION OF FIGURES

The invention will be described in greater detail in the attached drawings, in which.

In the figures, some embodiments of the invention are shown simplified for the sake of clarity. Similar parts are marked with the same reference numbers in the figures.

DETAILED DESCRIPTION OF SOME EMBODIMENTS OF THE INVENTION

Figure 1:
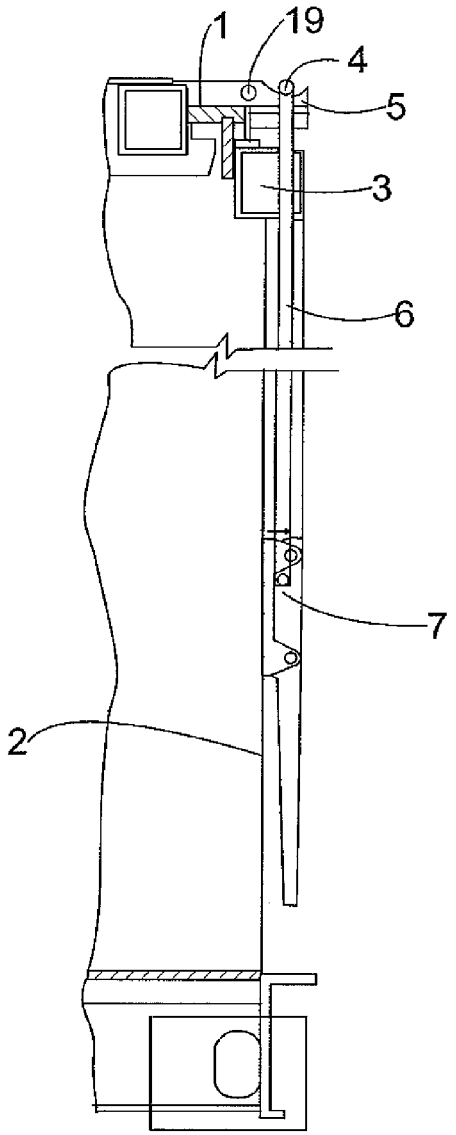
FIG. 1 is a schematic side view of a locking arrangement on the roof of a container.

FIG. 1 shows a container roof 1 that is arranged against a top beam 3 of a container wall 2 by its edge. The roof 1 is detachable, whereby it is possible to load goods to be transported into a container used for transporting goods and unload them from the top.

The roof 1 is locked in place by pressing a lug 5 of the roof 1 downward with a transverse part 4 of a locking means. The transverse part 4 is connected to a bar 6.

Figure 2:
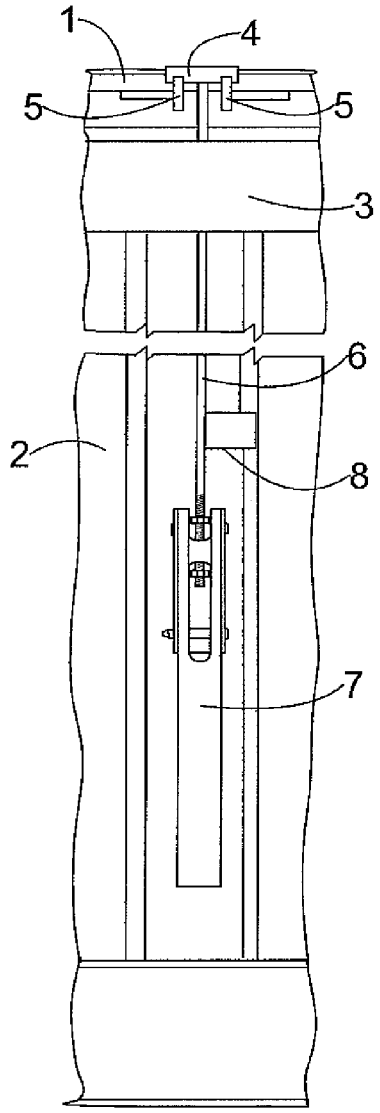
FIG. 2 is a schematic front view of a locking arrangement on the roof of a container.

In accordance with FIG. 2, the transverse part 4 extends into two directions from the bar 6, that is, the top end of the bar is T-shaped. There are two lugs 5, whereby the transverse part 4 settles on each lug 5 and the bar 6 extends downward between the lugs 5. The bar 6 is arranged to pass through an opening in the top beam 3, whereby the bar 6 can be firmly supported to the wall 2.

The locking arrangement also comprises a handle 7 arranged at the bottom end of the bar 6. The locking arrangement is operated with the handle 7 that is positioned relatively low, whereby, when operating the locking arrangement, it is not necessary climb higher than the bottom edge of the container.

The handle 7 is moved vertically. When the handle 7 is turned to its low position in the manner illustrated in the figures, the roof 1 is locked in place with the locking arrangement. When the handle 7 is turned to its top position, the transverse part 4 on top of the lugs 5 may be released and the roof 1 lifted away. The bar 6 is arranged to turn around its axis when the handle 7 is lifted away from the locked position. The bar 6 may be turned using a turning handle 8, for instance. When the transverse part 4 has been arranged on top of the lugs 5 in the position marked with a solid line in FIG. 3, the roof 1 can be locked in place. When the locking is released, the bar 6 and, thus, also the transverse part 4, is turned with the turning handle 8 into the position illustrated with a dashed line between the lugs 5, and the roof 1 may be lifted off the container.

Figure 4:
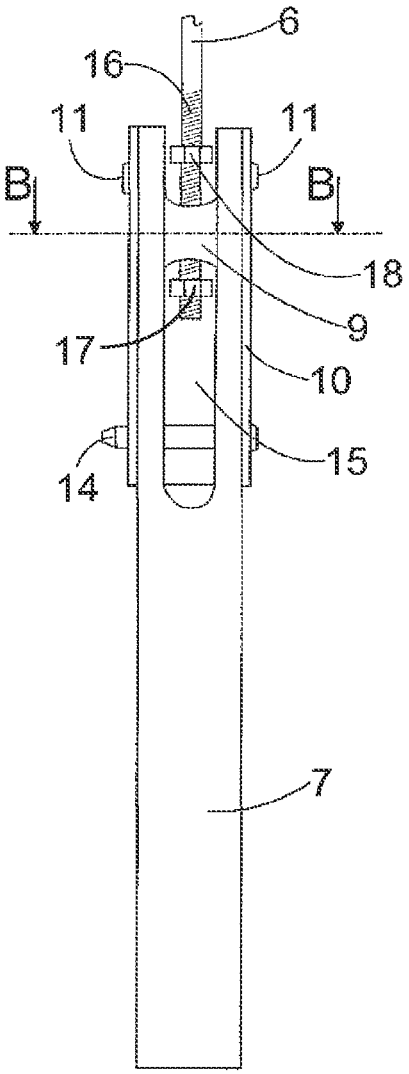
FIG. 4 is a schematic front view of a handle belonging to the locking arrangement.
Figure 6:
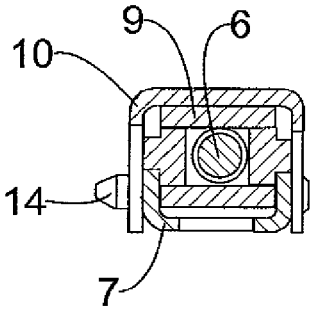
FIG. 6 shows the handle of FIG. 4 cut along line B-B of FIG. 4.
Figure 7:
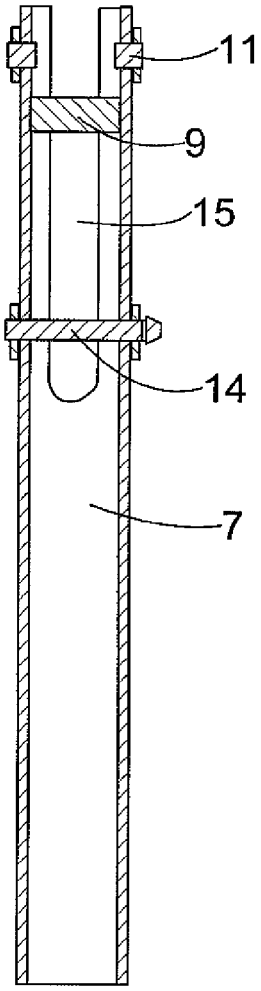
FIG. 7 shows the handle of FIG. 5 cut along line A-A of FIG. 5.

FIG. 4 shows the bottom part of the locking arrangement. A sleeve 9 is pivoted to the handle 7 in the manner illustrated in FIG. 6.

Figure 5:
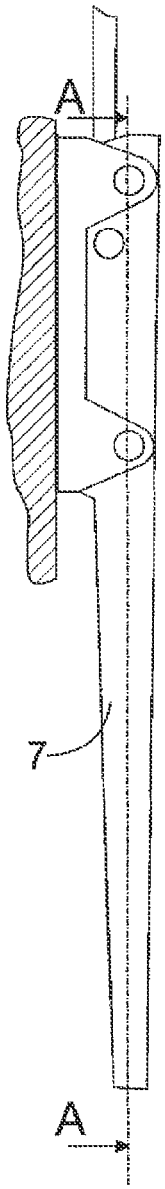
FIG. 5 is a schematic side view of the handle of FIG. 4.

FIG. 5 shows a fastener 10 that is fastened to the wall 2 by welding or riveting or in some other suitable manner. One end of the handle 7 is pivoted to the fastener 10 by means of pins 11. The pins 11 form a hinge so that the handle 7 can turn vertically around said pins 11.

The fastening point of the sleeve 9 to the handle 7 is arranged in such a manner that when the handle 7 is pressed down into the locked position, the fastening point is closer to the wall 2 than the centre axis of the pins 11 forming the hinge. Further, the fastening point of the sleeve and the axis are at a distance from each other, whereby when the handle 7 is pushed downward, the handle 7 pulls the bar 6 and, at the same time, the transverse part 4 downward. Because the fastening point of the sleeve is closer to the wall 2 than the axis, when the handle 7 is pressed down, a downward pulling force acts first on the bar 6, when the handle 7 is lifted, that is, when the locking is opened; in other words, the locking closes more tightly. The tightening continues until the fastening point and axis are at the mid-line of the bar 6, and after this the locking loosens. Due to the above structure, a force pulling the roof upward cannot lift the handle up; in other words, the locking arrangement cannot open by accident.

A locking pin 14 is arranged through holes in the handle 7 and fasteners 10 to ensure that the handle stays down. When the locking is to be opened, the locking pin 14 is removed and the handle 7 turned upward.

The handle 7 has a slot 15 that allows the handle 7 to turn upward without hitting the vertical bar 6. When the handle 7 is turned up, the bar 6 fits into the slot 15.

The bottom end of the bar 6 has a thread 16. Limiting members, that is, a bottom nut 17 and a top nut 18, are arranged into the thread 16. The limiting members keep an appropriate part of the bar 6 at the opening of the sleeve 9. With the bottom nut 17, it is possible to adjust how low the handle 7 pulls the bar 6 and the transverse part 4; in other words, how tight the locking is. The top nut 18 is used to select the position, where the turning position of the handle 7 starts to lift the bar 6 and transverse part 4 upward.

It is also possible to lift the roof 1 with the locking arrangement. The transverse part 4 is then arranged under the lugs 5 and the handle 7 is turned upward. A gap is thus formed between the container roof 1 and wall 2, and a lifting member or the fork of a fork-lift truck, for instance, can be arranged therein to lift the roof 1 off. The handle 7 can be locked into its top position as close to the bar 6 as possible by means of a chain or bar or locking pin, for instance, or some other corresponding arrangement.

Figure 8:
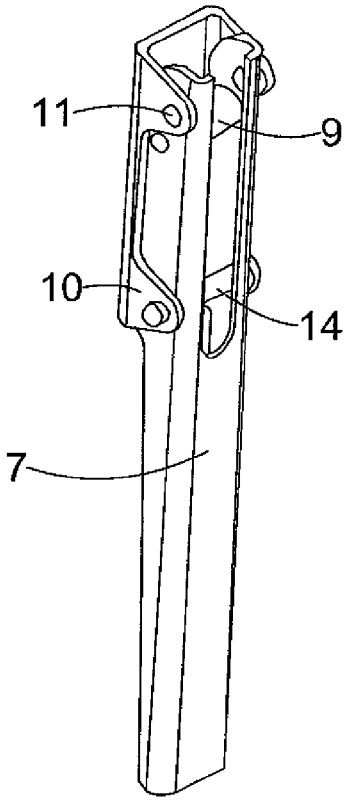
FIG. 8 is a schematic view of the handle of the locking arrangement as seen obliquely from the top.

For the sake of clarity, FIG. 8 shows a turning handle 7 without the bar 6 and the related limiting members. When the handle is in the locked position, the vertical bar 6 and the related limiting members are inside the handle 7, whereby these structures are safe from damage.

Figure 3:
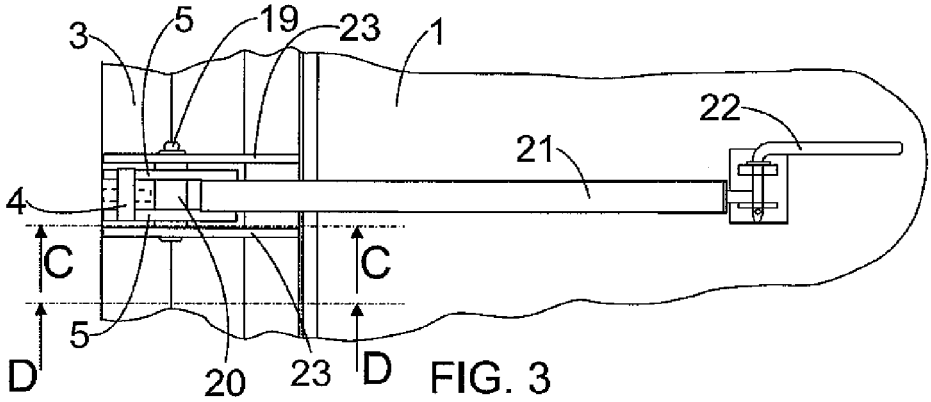
FIG. 3 is a schematic top view of a locking arrangement on the roof of a container.
Figure 9:
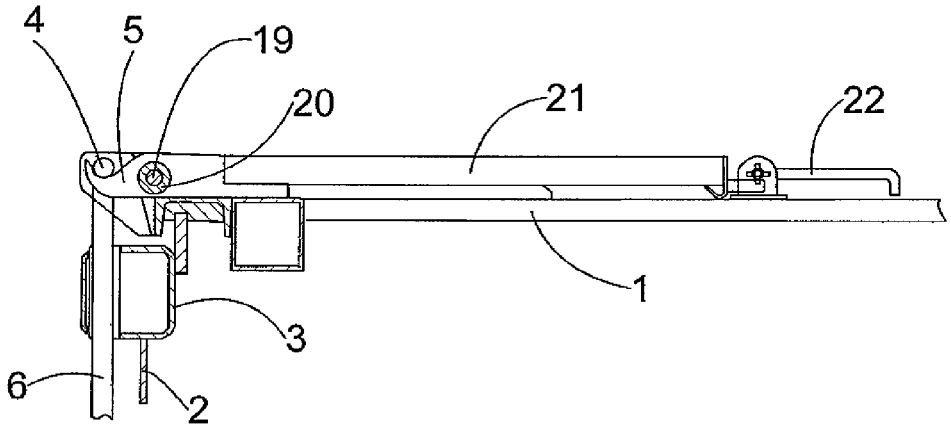
FIG. 9 is a schematic view of the locking arrangement of FIG. 3 cut along line C-C of FIG. 3.

As shown in FIGS. 1, 3 and 9, for instance, the lugs 5 are arranged to turn around a turning pin 19. This way, the lugs 5 can be turned away from beneath the transverse part 4 in the locked position.

A sleeve 20, to which the lugs 5 may be fastened, is arranged around the turning pin 19. This way, the sleeve 20 fastened to the lug 5 acts as a bearing around the turning pin 19.

The lugs 5 are further fastened to an arm 21 with which the lugs 5 may be turned. The arm 21 can be locked into a locked position to the roof 1 with a closure pin 22, for example. Thus, by locking the end of the arm 22 opposite the lugs 5 with a closure pin 22 to the roof 1, the lug 5 can be made to remain in its locked position under the transverse part 4. The locking of the container roof 1 can, thus, also be opened without moving the bar 6 or transverse part 4 by opening the closure pin 22 and turning the lugs 5 away from beneath the transverse part 4 with the arm 21.

The turning axis of the turning pin 19 is in the direction of the corner between the roof 1 and wall 2. The use of the locking arrangement is then easy and simple. The lugs 5 are, thus, arranged to turn around an axis in the direction of said corner, but if necessary the lug 5 may also be arranged to turn around an axis in some other direction.

The turning pin 19 is arranged to a support plate 23. The support plate 23 is, in turn, fixed to the roof 1. The support plates 23, in turn, have slots 24 in the manner shown in FIG. 10. The turning pin 19 is movable in the slots 24. The lugs 5 can then be moved forward from the position shown in FIG. 9. This facilitates the connection of the lugs 5 and the transverse part 4 to each other. When the turning pin 19 is in the position shown in FIG. 10, the turning handle 21 cannot be turned into a fully vertical position or at least clearly past the vertical position, because the bottom part of the lugs 5 hits the edge of the roof 1 or the side of the wall 2. However, when the turning pin 19 is moved to the front edge of the slot 24, the turning handle 21 can be turned past the vertical position and the lugs 5 pass the transverse part 4 for instance when the roof 1 is lowered in place.

Figure 10:
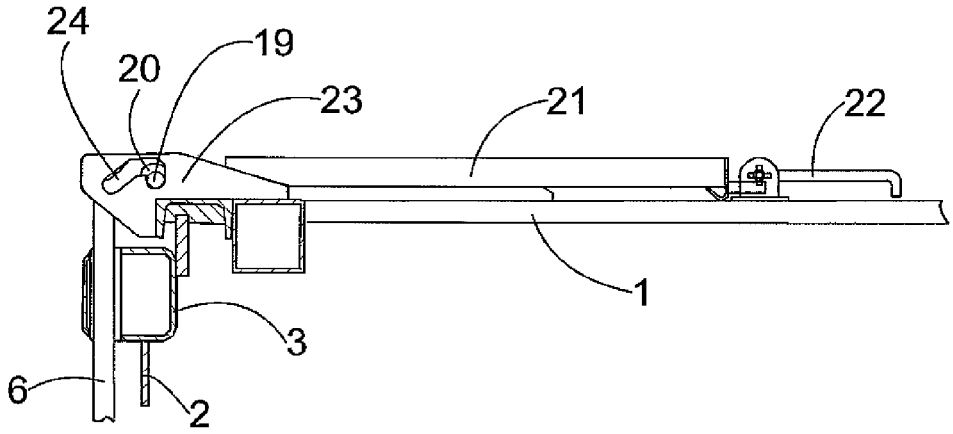
FIG. 10 is a schematic view of the locking arrangement of FIG. 3 cut along line D-D of FIG. 3.

The slot 24 has a bevelled section that starts from its front edge, whereby when the lugs 5 are turned into their locked position with the turning handle 21, the turning pin 19 slides relatively easily into a locking notch in the back edge of the slot 24, that is, into the position shown in FIG. 10.

In some cases, the features described in this application may be used as such, regardless of other features. On the other hand, the features described in this application may also be combined to provide various combinations as necessary.

The drawings and the related description are only intended to illustrate the idea of the invention. The invention may vary in its details within the scope of the claims.

In the embodiment shown in the figure, the bar 6 and the transverse part 4 are arranged to the container wall and the lugs 5 to the container roof 1. Further, the lugs may also be arranged to a wall, for instance, whereby the locking arrangement locks the vertical corner of two walls. This type of locking arrangement can be used in locking the platform of a lorry or in locking two walls of a container-like structure at an angle to each other.

The invention claimed is:

1. A locking arrangement that is arranged to lock together a first side and a second side positioned at an angle, the first side having a locking member comprising a transverse part (4) connected to a rod (6) that moves between a locked position and an unlocked position; and the second side having a turning pin (19) and at least one lug fastened to the turning pin so that the at least one lug turns around the turning pin, the at least one lug having a length in a longitudinal direction, and being comprised of i) a proximal end, ii) a distalmost end comprised of a recess that includes sequentially a recess beginning portion, a lowermost recess portion, and a terminating end tip portion, and iii) a pivot located between the proximal end and the recess beginning portion, the at least one lug being turnable about the pivot around the turning pin, the turning pin being transverse to the longitudinal direction of the at least one lug, wherein the transverse part is i) settable in the locked position on and above the lowermost recess portion of the at least one lug by downward movement of the rod pressing the transverse part of the locking member onto the lowermost recess portion of the at least one lug, in the locked position the lowermost recess portion of the at least one lug being in vertical alignment below the transverse part and the terminating end tip portion of the at least one lug being on a first side of the transverse part, and ii) releasable from the locked position on and above the at least one lug, and wherein i) the at least one lug is turnable about the pivot around the turning pin so that the terminating end tip portion is moved from the first side of the transverse part to an opposite, second side of the transverse part, and the lowermost recess portion of the at least one lug is moved away from being in vertical alignment below the transverse part to the opposite, second side of the transverse part, and ii) lockable to remain below the transverse part in the locked position.

2. The locking arrangement as claimed in claim 1, wherein the at least one lug is turnable around the turning pin in an axis in the direction of the corner between the first and second sides.

3. The locking arrangement as claimed in claim 1, further comprising a sleeve (20) to which the at least one lug is fastened, the sleeve acting as a bearing around the turning pin.

4. The locking arrangement as claimed in claim 3, further comprising support plates fixed to the second side, wherein the turning pin is arranged to the support plates that are fixed to the second side.

5. The locking arrangement as claimed in claim 4, wherein the support plates have slots in which the turning pin is movable to change the position of the at least one lug.

6. The locking arrangement as claimed in claim 3, further comprising an arm connected to the at least one lug, the arm being operable to turn the at least one lug away from beneath the transverse part, without moving the rod, and thereby release the transverse part from the locked position.

7. The locking arrangement as claimed in claim 1, wherein at least two lugs are arranged to the second side and the transverse part extends from the vertical bar into two directions such that the top end of the vertical bar is T-shaped, whereby the bar in its locked position is between the lugs and the transverse part is on at least two lugs.

8. The locking arrangement as claimed in claim 1, wherein the first side is a wall of a transport container and the second side is a roof of the transport container, whereby the locking arrangement is a locking arrangement for the container roof.

9. A locking arrangement, comprising:

a first side, the first side being a wall of a container;

a second side detachably positioned over and at an angle with respect to the first side, the second side being a roof of the container;

a support attached to the first side;

a locking member located on the first side, the locking member comprising a transverse part connected to a rod, the rod supported by the support and extending along a height of the first side and being connected to the transverse part, the transverse part extending into two directions from the rod such that a top end of the locking member is T-shaped, the rod having an axis and being turnable about the axis;

two turnable lugs located on the second side and extending beyond a periphery edge of the second side, each of the lugs having a distalmost end, each of the two lugs being fastened to a turning pin so that each of the two lugs turn around the turning pin, each lug having a length in a longitudinal direction, and being comprised of i) a proximal end, ii) a distalmost end comprised of a recess that includes sequentially a recess beginning portion, a lowermost recess portion, and a terminating end tip portion, and iii) a pivot located between the proximal end and the recess beginning portion, the two lugs being turnable about the pivot around the turning pin, the turning pin being transverse to the longitudinal direction of the two lugs, wherein the transverse part is settable in a locked position with the transverse part extending across and bearing against the lowermost recess portion of the two lugs with the terminating end tip portion of each lug being on a first side of the at least one transverse part, the transverse part pressing the two lugs downward against the first side and the rod extending downward between the two lugs, wherein, by the rod being turned about the axis of the rod, the transverse part turns away from bearing on the lowermost recess portion of the two lugs thereby releasing the two lugs from contact with the transverse part and from the locked position; and an arm connected to the two lugs, the arm being operable to turn the two lugs, including an entirety of the distalmost end of each lug, away from being vertically aligned beneath the transverse part with the distalmost end of the each lug being moved to an opposite, second side of the transverse part, without moving the rod or the transverse part, and thereby releasing the transverse part from the locked position.

10. The locking arrangement of claim 9, further comprising:

a handle arranged at a bottom end of the rod and connected to the support, the handle being movable and having a low position and a top position, wherein when the handle is in the low position, the locking member is in the locked position and the second side is locked in place, and wherein when the handle is in the top position, the transverse part on top of the two lugs is releasable.

11. The locking arrangement of claim 9, further comprising:

a closure element that locks the arm into a locked position and prevents the arm from being operated to turn the two lugs away from beneath the transverse part so that the two lugs remain below the transverse part in the locked position.

12. The locking arrangement of claim 9, further comprising a sleeve (20) to which the two lugs are fastened, the sleeve acting as a bearing around the turning pin.

13. The locking arrangement as claimed in claim 12, wherein the arm further comprising a closure pin, the closure pin operable to lock the arm to make the two lugs remain in the locked position under the transverse part.

14. A locking arrangement, comprising:

a first side, the first side being a wall of a container;

a second side detachably positioned over and at an angle with respect to the first side, the second side being a roof of the container;

a locking member located on the first side, the locking member comprising a transverse part connected to a rod, the rod extending along a height of the first side and being connected to the transverse part, the transverse part extending into two directions from the rod such that a top end of the locking member is T-shaped, the rod having an axis and being turnable about the axis;

a turning pin and a turnable lug located on the second side, the lug being fastened to the turning pin so that the lug turns around the turning pin, the lug having a length in a longitudinal direction, and being comprised of i) a proximal end, ii) a distalmost end comprised of a recess that includes sequentially a recess beginning portion, a lowermost recess portion, and a terminating end tip portion, and iii) a pivot located between the proximal end and the recess beginning portion, the lug being turnable about the pivot around the turning pin, the turning pin being transverse to the longitudinal direction of the lug, wherein the transverse part is settable in a locked position with the transverse part extending across and bearing against the lowermost recess portion of the lug with the terminating end tip portion of the lug being on a first side of the transverse part, the transverse part pressing the lug downward against the first side with the rod extending downward below the lug, wherein, by the rod being turned about the axis of the rod, the transverse part turns away from bearing on the lowermost recess portion of the lug thereby releasing the lug from contact with the transverse part and from the locked position; and an arm connected to the lug, the arm being operable to turn the lug, including an entirety of the distalmost end of the lug, away from being vertically aligned beneath the transverse part with the distalmost end of the lug being moved to an opposite, second side of the transverse part, without moving the rod or the transverse part, and thereby releasing the transverse part from the locked position.

15. The locking arrangement of claim 14, further comprising:

a support attached to the first side; and a handle arranged at a bottom end of the rod and connected to the support, the handle being movable and having a low position and a top position, wherein when the handle is in the low position, the locking member is in the locked position and the second side is locked in place, and wherein when the handle is in the top position, the transverse part on top of the lug is releasable.

16. The locking arrangement of claim 14, further comprising:

a closure element that locks the arm into a locked position and prevents the arm from being operated to turn the lug away from beneath the transverse part so that the lug remains below the transverse part in the locked position.

17. The locking arrangement of claim 14, further comprising a sleeve (20) to which the lug is fastened, the sleeve acting as a bearing around the turning pin.

18. The locking arrangement as claimed in claim 17, wherein the arm further comprising a closure pin, the closure pin operable to lock the arm to make the lug remain in the locked position under the transverse part.

* * * * *